United States Patent [19]

Umesato et al.

[11] Patent Number: 5,064,390

[45] Date of Patent: Nov. 12, 1991

[54] COAXIAL PIN CONNECTOR HAVING AN ARRAY OF CONDUCTIVE HOLLOW CYLINDRICAL STRUCTURES

[75] Inventors: Shoji Umesato; Yoshikatsu Okada, both of Tokyo; Katsuhiko Sakamoto, Kanagawa, all of Japan

[73] Assignee: NEC Corporation, Tokyo, Japan

[21] Appl. No.: 582,661

[22] Filed: Sep. 12, 1990

[30] Foreign Application Priority Data

Sep. 12, 1989 [JP] Japan ..... 1-236761

[51] Int. Cl.[5] ..... H01R 9/22

[52] U.S. Cl. ..... 439/721; 439/729; 439/579

[58] Field of Search ..... 439/46–50, 439/509–511, 512, 513, 578–585, 675, 55, 63, 92, 101, 108, 721, 729, 723

[56] References Cited

U.S. PATENT DOCUMENTS

| | | | |
|---|---|---|---|
| 3,587,028 | 6/1971 | Uberbacher | 439/49 |
| 4,707,040 | 11/1987 | Hansel, III | 439/510 |
| 4,767,345 | 8/1988 | Gutter et al. | 439/92 |
| 4,875,865 | 10/1989 | Oemler, Jr.et al. | 439/101 |
| 4,889,500 | 12/1989 | Lazar et al. | 439/579 |
| 4,941,831 | 7/1990 | Zengler et al. | 439/579 |

FOREIGN PATENT DOCUMENTS 62-251425 4/1989 Japan .

*Primary Examiner*—David L. Pirlot

*Attorney, Agent, or Firm*—Burns, Doane, Swecker & Mathis

[57] ABSTRACT

A coaxial pin array connector comprises a top member having guide holes corresponding to coaxial cables, and an intermediate, conductive member having throughholes, respectively corresponding to and aligned with the guide holes. A bottom, insulative member is provided having first throughholes for admitting signal pins of a circuit board and second throughholes for admitting grounding pins of the circuit board and recesses for receiving power pins of the circuit board. Conductive cylindrical hollow structures are respectively positioned in the throughholes of the intermediate member and extend between the top and bottom members to allow the coaxial cable pins to be admitted from the guide holes to the bottom member and make electrical contact with the signal pins. Each of the hollow structures has inwardly bent contacts for making pressure contact with the pin of a corresponding coaxial cable and an outwardly bent contact forming a pair of contacts with the outwardly bent contact of an adjacent hollow structure so that one of the grounding pins engages between the paired contacts when inserted through one of the second throughholes of the bottom member.

7 Claims, 4 Drawing Sheets

COAXIAL PIN CONNECTOR HAVING AN ARRAY OF CONDUCTIVE HOLLOW CYLINDRICAL STRUCTURES

BACKGROUND OF THE INVENTION

The present invention relates generally to pin connectors, and more specifically to a pin array connector for coaxial cables which carry high-speed digital signals from computers or the like.

One typical example of prior art coaxial pin array connectors is shown and described in Japanese Patent Application (Tokugansho) 62-251425. This prior art connector comprises a block having throughholes for receiving pins of coaxial cables and a housing for receiving the block therein. The housing is formed with throughholes corresponding to those of the block for admitting signal pins of a circuit board therethrough into contact with the inner connectors of the pins of the coaxial cables. At the interface between the block and the housing are provided laminates of thin metal plates which are so cut and shaped as to produce various contacts on a two-dimensional space for establishing electrical connections between the outer conductors of the coaxial pins and grounding pins of the circuit board.

However, the number of such coaxial pins increases with ever increasing complexity of integrated circuits, and high level of precision is required to produce many contacts in a small area. A recent demand indicates that a pin connector needs to hold as many as 40×40 pins on a two-dimensional plane. One shortcoming of the prior art coaxial pin connector is that due to inherent manufacturing tolerances difficulty arises in precisely laminating the thin metal plates. In addition, difficulty arises in properly insulating power pins of the circuit board from the surrounding metal parts of the connector if such power pins have the same length as signal and grounding pins.

SUMMARY OF THE INVENTION

It is therefore an object of the present invention to provide an improved coaxial pin array connector capable of coupling an array of many coaxial pins in a small space.

Another object of this invention is to allow pins of the same length to be used for printed circuit boards for connection with the coaxial cables.

A further object of this invention is to provide an improved coaxial pin array connector which is easy to manufacture.

According to the present invention, there is provided a coaxial pin array connector for connecting a plurality of pins of coaxial cables to a plurality of corresponding pins of a circuit board. The connector comprises a first member having a plurality of throughholes corresponding to the coaxial cables. A second member of insulative material is spaced from the first member, the second member having a plurality of first throughholes corresponding to signal pins of the circuit board, a plurality of second throughholes for inserting grounding pins of the circuit board and a plurality of recesses for receiving power pins of the circuit board. Electrically conductive cylindrical hollow structures are respectively positioned in the throughholes of the first member and extend to the second member to allow the pins of the coaxial cables to be inserted therethrough to the second member and make electrical contact with the signal pins. Each of the hollow structures has inwardly bent contact portions for making pressure contact with the pin of a corresponding coaxial cable and an outwardly bent contact portion which forms a pair of contacts with the outwardly bent contact portion of an adjacent hollow structure so that each of the grounding pins can be inserted through a corresponding one of the second throughholes of the second member and engages between the paired contacts.

In preferred embodiments, the first member is formed of an electrically conductive material for connecting the outer conductors of the coaxial pins to ground. The first member is formed with notches adjacent the circumference of each of its throughholes, and each of the hollow cylindrical structures is formed with projections for engaging with the notches. This enables each cylindrical structure to be easily angularly oriented in a desired direction during manufacture. Each of the hollow cylindrical structures may be formed with resilient outwardly bent portions which are bent inwardly when the hollow structure is forced through one of the throughholes of the first member during manufacture and spring back to original positions to hold the cylindrical structure in position.

BRIEF DESCRIPTION OF THE DRAWINGS

The present invention will be described in further detail with reference to the accompanying drawings, in which.

DETAILED DESCRIPTION

Figure 1:
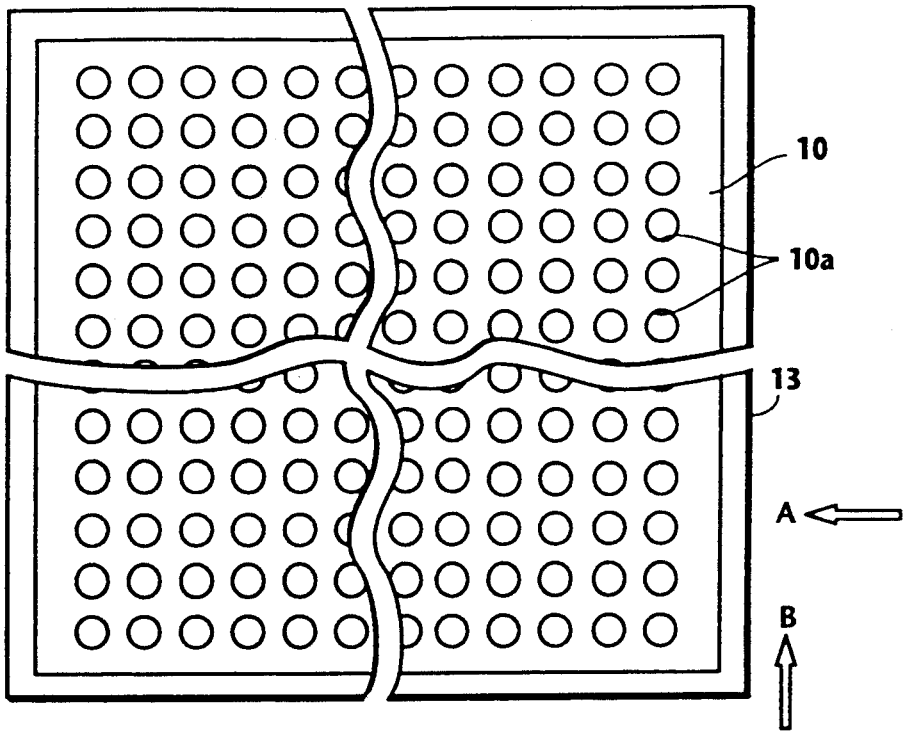
FIG. 1 is a top plan view of a coaxial pin array connector according to the present invention.
Figure 2A:
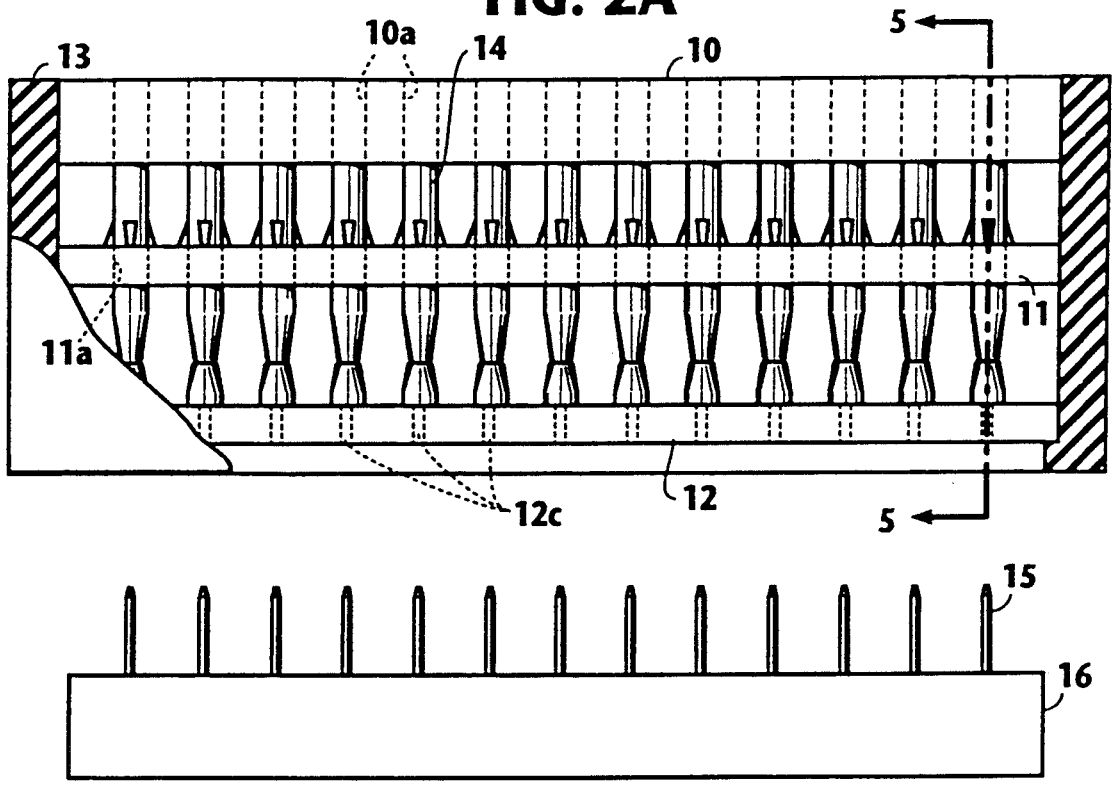
FIGS. 2A and 2B are partly broken, elevational views of the connector as seen in the direction of arrows A and B of FIG. 1, respectively.
Figure 2B:
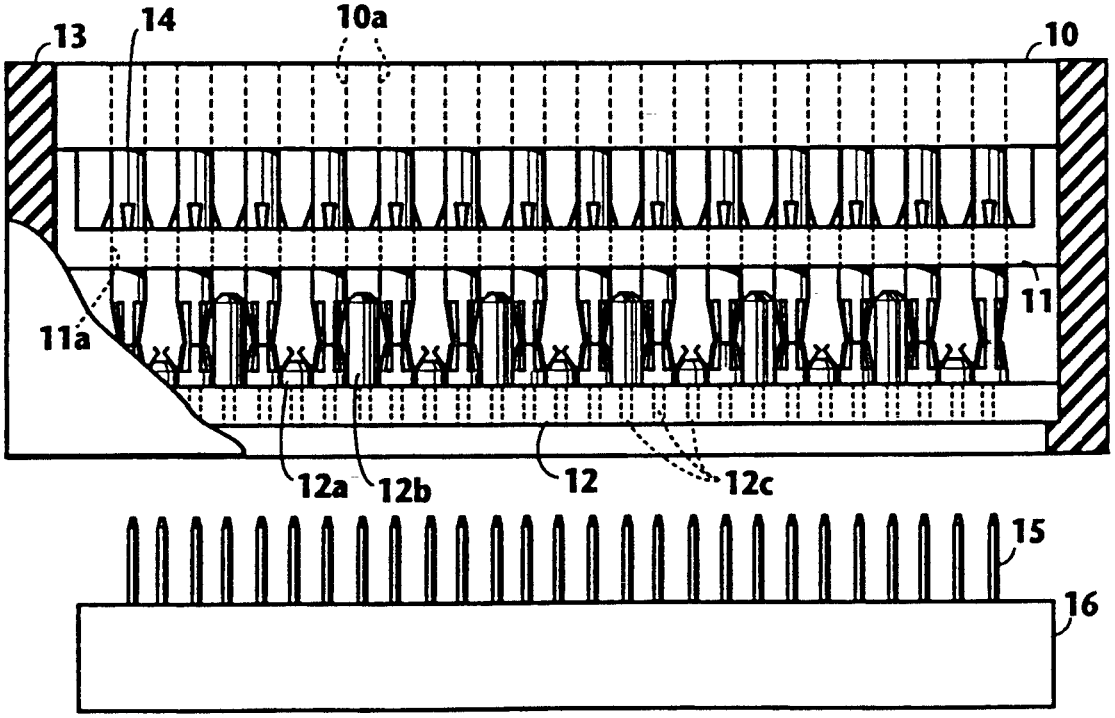

Referring to FIGS. 1, 2A and 2B, the coaxial pin array connector of this invention comprises a top, insulative member 10, an intermediate, conductive member 11 and a bottom, insulative member 12, all of which are housed in a frame 13. Top member 10 is formed with a matrix array of coaxial-pin guide holes 10*a*, and likewise, intermediate member 11 is formed with contact-holding holes 11*a* which are aligned respectively with the holes of top member 10. Metal contacts 14 extend respectively through the holes 11*a* of intermediate member 11 and are firmly secured in position between top and bottom members 10 and 12. Bottom member 12 is formed with juxtaposed columns, or short projections 12*a* and juxtaposed columns, or long projections 12*b*, each projection being located between adjacent contacts 14 which are arranged in a row. An array of solid, conductive pins 15 of equal lengths are juxtaposed on a printed circuit board 16. Pins 15 respectively extend through pin holes 12*c* when printed circuit board 16 is engaged with the bottom member 12 of the connector.

Figure 3:
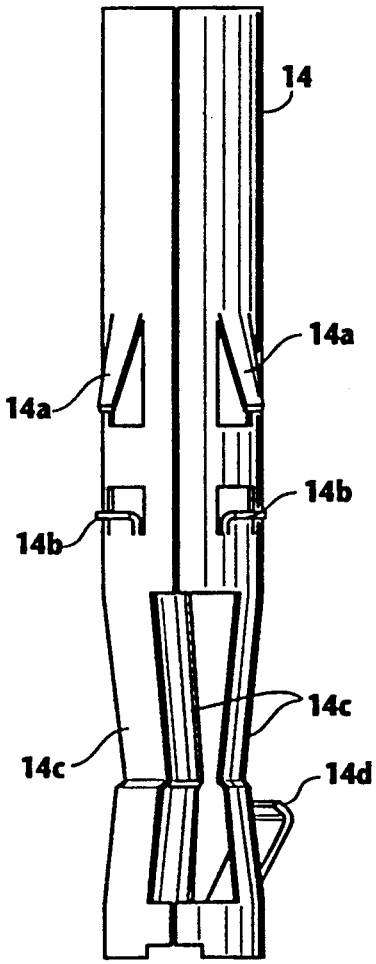
FIG. 3 is a perspective view of the metal contact of this invention.
Figure 4:
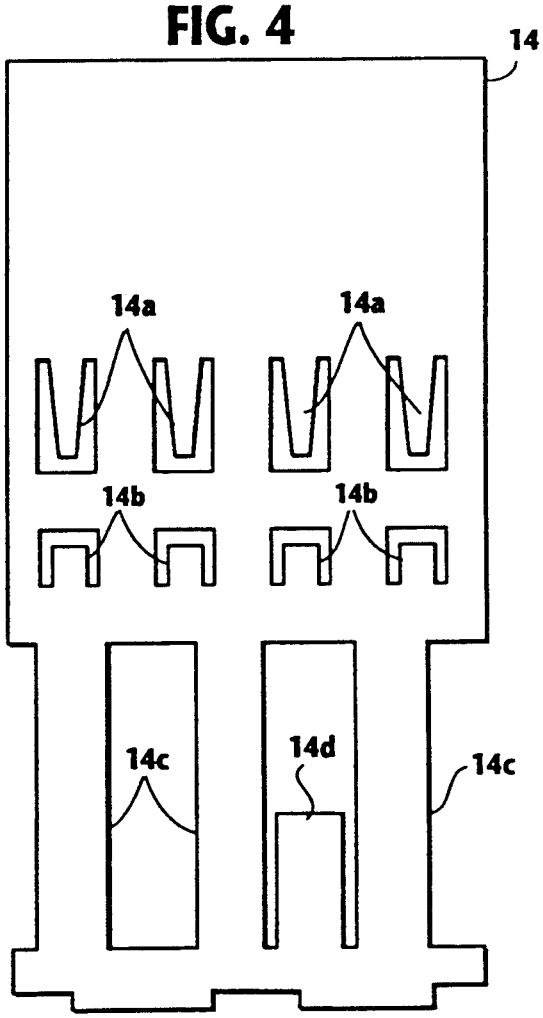
FIG. 4 is a view illustrating the developed form of the contact of FIG. 3.

As illustrated in detail in FIG. 3, each contact 14 is of a generally cylindrical hollow structure which is formed with four downwardly outwardly tapered bent projections 14*a* spaced apart at 90 degrees from each other on the circumference of the cylindrical structure and four outwardly bent, horizontal short projections 14*b* respectively located below projections 14*a*. Contact 14 has three limb sections 14*c* spaced at 120 degrees apart from each other, each limb section being inwardly bent to act as spring contacts. Between two limb sections 14*c* is formed an outwardly bent contact portion 14*d* whose top end is bent to form a point contact with a grounding pin to be described later. FIG. 4 shows a developed form of the contact 14. Each contact 14 is produced from a metal blank sheet by stamping it into a cutout form and rolling it into the shape of a cylinder along its long axis.

Figure 5:
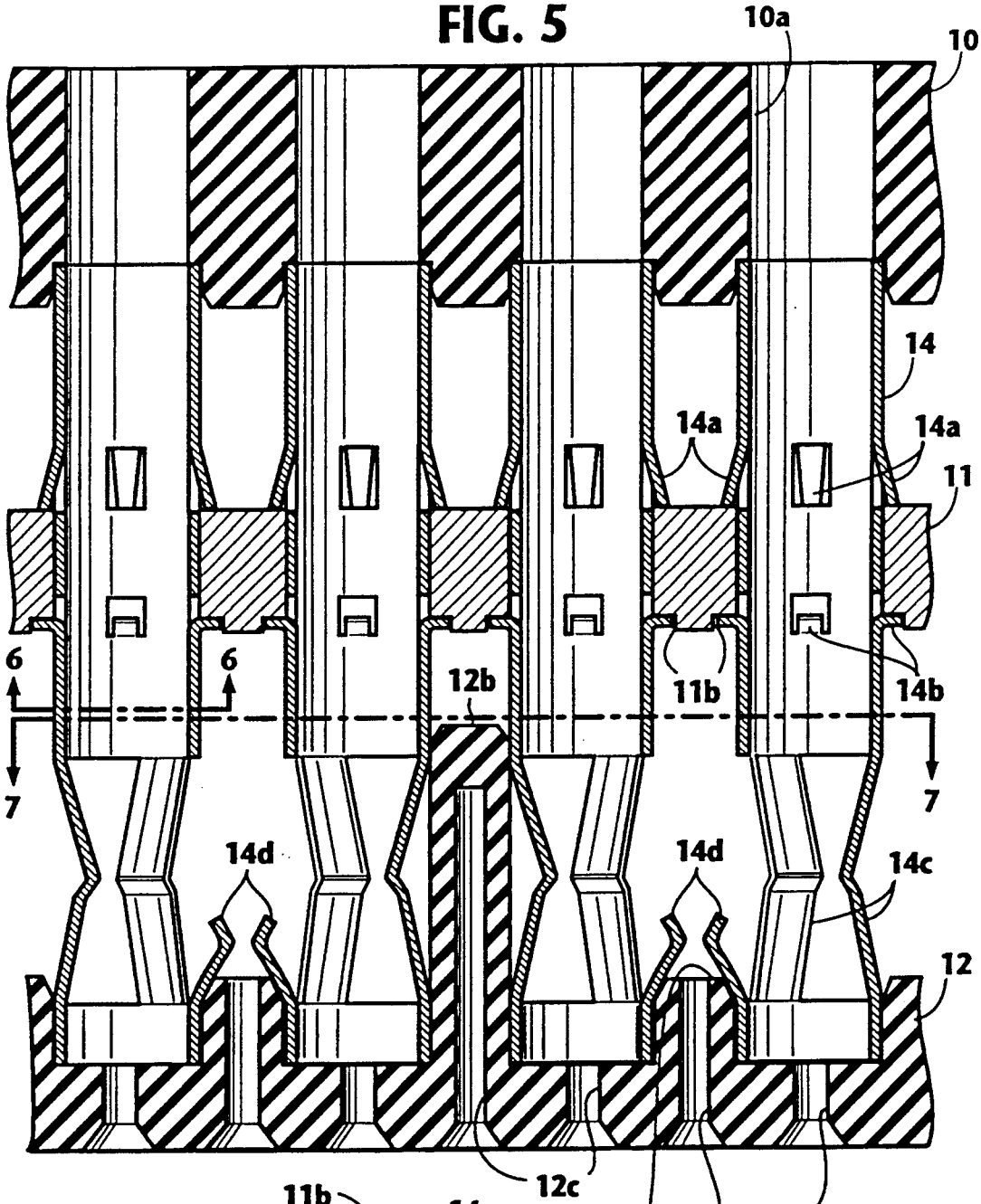
FIG. 5 is a cross-sectional view of the connector taken along the line 5—5 of FIG. 2A.
Figure 6:
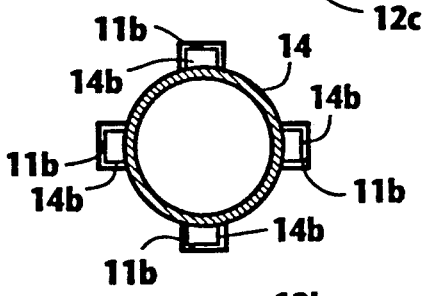
FIG. 6 is a cross-sectional view of the connector taken along the line 6—6 of FIG. 5.
Figure 7:
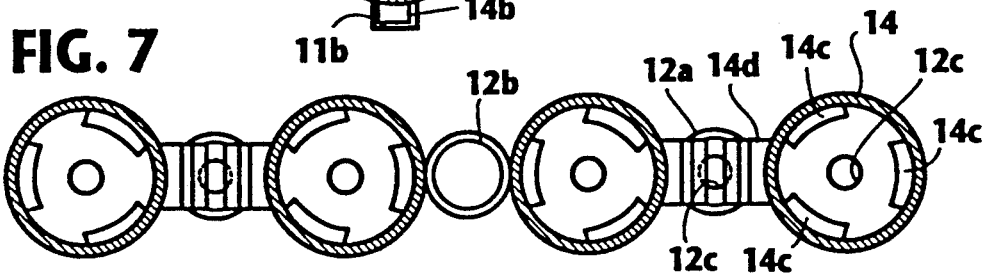
FIG. 7 is a cross-sectional view of the connector taken along the line 7—7 of FIG. 5.

As is seen in FIGS. 5, 6 and 7, intermediate member 12 is formed with a plurality of sets of four recesses or notches 11*b*, with the notches of each set being angularly spaced at 90 degrees apart along the circumference of each hole 11*a* to respectively receive the horizontal short projections 14*b* of a corresponding contact 14, so that the angular orientation of each contact 14 can be easily and precisely determined.

During manufacture, two jigs are used for inserting contacts 14 into holes 11*a* of the intermediate member 11. This is accomplished by inserting one of the jigs into a contact 14 from end thereof and inserting the other jig through a hole 11*a* into that contact from the other end thereof. The jigs are moved against the forces of the tapered projections 14*a* of the contact while rotating it along its axis until its horizontal projections 14*b* come into engagement with the notches 11*b* and the tapered projections 14*a* spring back to their original positions. When the contact 14 is brought into position, the jigs are removed therefrom.

The lower end of each guide hole 10*a* is offset outwardly to snugly receive the upper end of corresponding contact 14. Limb sections 14*c* of each contact 14 are inwardly bent toward its center axis to come into pressure contact with a coaxial pin when the latter is forced downward through the guide hole 10*a* to the bottom member 12. Contacts 14 are arranged so that the contact portions 14*d* of adjacent contacts 14 are brought into contact with one of the juxtaposed short projections 12*a* to form a pair of biased spring contacts 14*d* and that the limb sections 14*c* of adjacent contacts 14 are located one on each side of a long projection 12*b*. Bottom member 12 is further provided with pin holes 12*c* for respectively receiving the solid pins 15 of printed circuit board 16.

Figure 8:
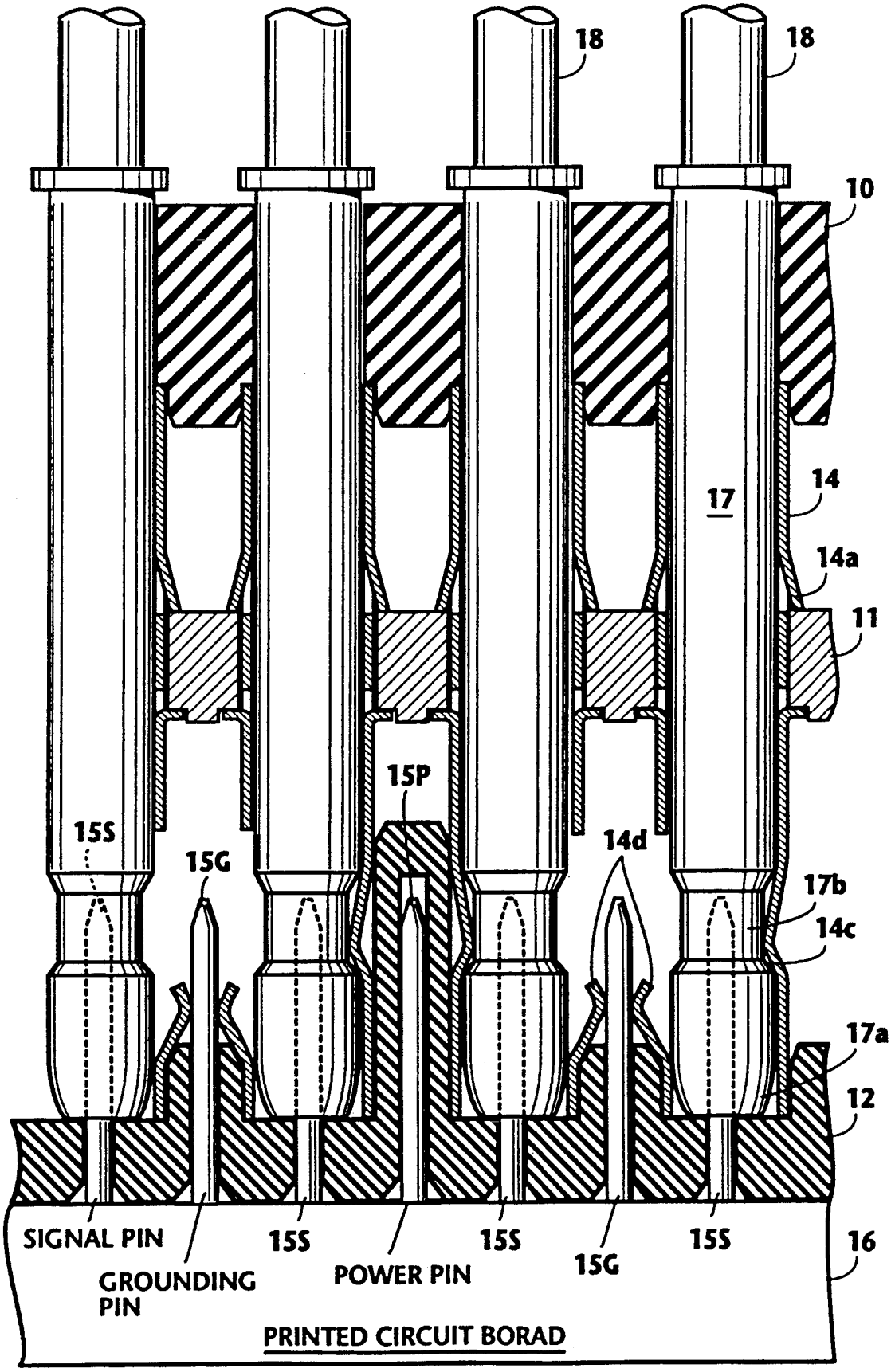
FIG. 8 is a cross-sectional view of the connector when coaxial cable pins and printed-circuit board pins are inserted.

In FIG. 8, coaxial pins 17 are shown inserted into respective metal contacts 14. Coaxial cables 18 for carrying high-speed signals are terminated to the respective coaxial pins 17. Each coaxial pin 17 is formed of hollow cylinder having a tapered end 17*a* for ease of insertion and an inwardly offset portion 17*b* with which the limb sections 14*c* are brought into pressure contact so that coaxial pins 17 are firmly held in position. The hollow cylinder of the coaxial pin 17 serves as an outer conductor of the coaxial cable. The outer conductors of all metal contacts 14 are connected respectively to the outer conductors of the associated coaxial cables and are electrically connected together by intermediate member 11 on contacting with the limb sections 14*c* of the corresponding contacts 14. Coaxial pin 17 has an inner, hollow conductor that extends from the core of the associated cable to its tapered end and is insulated from its outer conductor.

Printed circuit board 16 has signal pins 15S, grounding pins 15G and power pins 15P. Signal pins 15S account for fifty percent of all pins 15 and grounding pins 15G and power pins 15P each account for twenty-five percent of the pins 15. When in use, signal pins 15S are inserted into the inner conductor of coaxial pin 17 as indicated by dotted lines in FIG. 8, and grounding pins 15G are forced through the paired flaps 14*d*, while the power pin 15P is inserted into the hole of projection 12*b*.

Therefore, signals from the printed circuit board 16 are respectively transmitted to the associated coaxial cables 18, and the outer conductors of all coaxial pins 17 are connected to the ground terminal of the printed circuit board through flaps 14*d*. Since one of the objects of this invention is to allow identical pins to be used by the printed circuit board regardless of their usage, the power voltages of the printed circuit board appear at power pins 15P. However, they are insulated from the surrounding elements by the projections 12*b*.

The foregoing description shows only one preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. A coaxial pin array connector for connecting a plurality of pins of coaxial cables to a plurality of corresponding pins of a circuit board, said pins of the circuit board having equal lengths, comprising:

a first member having a plurality of throughholes corresponding to said coaxial cables;

a second, insulative member spaced from said first member, said second member having a plurality of first throughholes corresponding to said signal pins, a plurality of second throughholes for admitting grounding pins of said circuit board and a plurality of recesses for receiving power pins of said circuit board; and a plurality of electrically conductive cylindrical hollow structures respectively positioned in the throughholes of said first member and extending to said second member to allow said pins of said coaxial cables to respectively extend through said hollow structures into electrical contact with said signal pins respectively, each of said hollow structures having inwardly bent contact portions for making pressure contact with the pin of a corresponding one of said coaxial cables and an outwardly bent contact portion for forming a pair of contacts with an outwardly bent contact portion of an adjacent hollow structure so that each of said grounding pins is inserted through a corresponding one of said second throughholes of said second member and engages between said paired contacts.

2. A coaxial pin array connector as claimed in claim 1, wherein said second member is formed with a plurality of first juxtaposed projections through which said throughholes of said second member respectively extend and a plurality of second juxtaposed projections in which said recesses are respectively formed, and wherein each of said first juxtaposed projections is disposed between said contacts of each pair to define the spacing therebetween before a grounding pin is inserted through said paired contacts.

3. A coaxial pin array connector as claimed in claim 1, wherein each of said cylindrical structures is formed of a cutout from a metal blank sheet and rolled into a cylinder.

4. A coaxial pin array connector as claimed in claim 1, wherein said first member is formed of an electrically conductive material.

5. A coaxial pin array connector as claimed in claim 4, further comprising a third member of insulative material having a plurality of guide holes corresponding to said coaxial cables and aligned respectively with the throughholes of said first member to allow the pins of said coaxial cables to be inserted through said guide holes into said cylindrical hollow structures.

6. A coaxial pin array connector as claimed in claim 1, wherein said first member is formed with one or more notches adjacent the circumference of each of the throughholes thereof, and each of said hollow cylindrical structures is formed with one or more projections for engaging with said one or more notches.

7. A coaxial pin array connector as claimed in claim 6, wherein each of said hollow cylindrical structures is formed with a plurality of resilient portions outwardly bent from the circumference thereof, said outwardly bent resilient portions being flexible enough to be bent inwardly to allow said cylindrical hollow structure to be forced through a corresponding one of said throughholes of said first member and spring back to original positions to hold said structure in position when said projections of the cylindrical structure are engaged with said notches.

* * * * *